US010961995B2

(12) United States Patent
Mayorca

(10) Patent No.: US 10,961,995 B2
(45) Date of Patent: Mar. 30, 2021

(54) METHOD AND EQUIPMENT FOR IMPROVING THE EFFICIENCY OF COMPRESSORS AND REFRIGERATORS

(71) Applicant: Aurelio Mayorca, Santa Catarina (BR)

(72) Inventor: Aurelio Mayorca, Santa Catarina (BR)

( * ) Notice: Subject to any disclaimer, the term of this patent is extended or adjusted under 35 U.S.C. 154(b) by 0 days.

(21) Appl. No.: 15/174,573

(22) Filed: Jun. 6, 2016

(65) Prior Publication Data

US 2016/0281701 A1 Sep. 29, 2016

Related U.S. Application Data

(63) Continuation-in-part of application No. 13/143,869, filed as application No. PCT/BR2010/000008 on Jan. 8, 2010.

(30) Foreign Application Priority Data

Jan. 9, 2009 (BR) ..... 0903956

(51) Int. Cl.
*F04B 27/04* (2006.01)
*F04B 39/00* (2006.01)
(Continued)

(52) U.S. Cl.
CPC ..... *F04B 27/0409* (2013.01); *F04B 25/005* (2013.01); *F04B 27/005* (2013.01);
(Continued)

(58) Field of Classification Search
CPC ..... F04B 27/0404; F04B 27/04; F04B 27/02; F04B 27/0409; F04B 1/0408;
(Continued)

(56) References Cited

U.S. PATENT DOCUMENTS 1,329,348 A * 1/1920 Copeland ..... F04B 27/005 384/13
1,747,457 A * 2/1930 Putnam ..... F04B 27/02 92/138

(Continued)

FOREIGN PATENT DOCUMENTS

BR 9600527 A 12/1997
CA 2431298 A1 12/2003

(Continued)

OTHER PUBLICATIONS

International Search Report for PCT/BR2010/000008, English Translation and original attached together, Completed by the Brazilian Patent Office dated Apr. 16, 2010, 8 Pages all together.

*Primary Examiner* — Christopher S Bobish
(74) *Attorney, Agent, or Firm* — The Concept Law Group, PA; Scott D. Smiley; Scott M. Garrett

(57) ABSTRACT

A hermetic compressor may include a crankshaft having an input shaft rotatably supported on the cast-iron block along the crankshaft axis and connected to the electric motor rotary output, and an eccentric crankpin orbitally rotating about the axis as the crankshaft is rotated. A pair of opposed pistons may lie on the common plane. Each piston may be pivotably connected to one of the connecting rod piston ends to drive the pistons in an oscillatory manner within the cylinders as the crankshaft rotates. The piston and cylinder pairs may cause fluid to be pumped from the inlet port to the outlet port as the piston oscillates varying the volume of the enclosed space bound by the piston and the cylinder pairs.

17 Claims, 5 Drawing Sheets

(51) Int. Cl.
*F04B 27/00* (2006.01)
*F04B 27/02* (2006.01)
*F04B 35/04* (2006.01)
*F04B 39/12* (2006.01)
*F04B 25/00* (2006.01)

(52) U.S. Cl.
CPC ..... *F04B 27/02* (2013.01); *F04B 27/04* (2013.01); *F04B 27/0404* (2013.01); *F04B 35/04* (2013.01); *F04B 39/0022* (2013.01); *F04B 39/0094* (2013.01); *F04B 39/122* (2013.01); *F04B 39/125* (2013.01)

(58) Field of Classification Search
CPC .. F04B 1/0439; F04B 25/005; F04B 39/0022; F04B 39/122; F04B 27/005
USPC ..... 417/902, 254
See application file for complete search history.

(56) References Cited

U.S. PATENT DOCUMENTS 1,820,883 A * 8/1931 Hueber ..... F04B 27/0409 417/273
2,179,268 A * 11/1939 Neeson ..... F04B 39/00 417/363
2,225,228 A * 12/1940 Neeson ..... F16N 13/20 184/31
2,323,068 A * 6/1943 Maniscalco ..... F04B 25/005 417/261
2,483,007 A * 9/1949 Higham ..... F25B 31/02 417/419
2,965,289 A * 12/1960 Weibel, Jr. ..... F25B 31/02 310/51
3,162,360 A * 12/1964 Privon ..... F04B 39/0246 310/90
3,401,873 A * 9/1968 Privon ..... F25B 31/02 417/312
3,692,434 A * 9/1972 Schnear ..... F04B 27/053 417/266
3,757,581 A * 9/1973 Mankin ..... G01F 3/18 73/247
3,762,837 A * 10/1973 Ellis ..... F04B 39/12 384/205
3,763,659 A * 10/1973 Hover ..... F25B 31/02 62/115
3,785,453 A * 1/1974 Buonocore ..... F04B 39/0055 181/211
3,817,661 A * 6/1974 Ingalls ..... F04B 39/0055 181/240
3,857,652 A * 12/1974 Thayer ..... F04B 39/06 184/104.1
4,236,874 A * 12/1980 Sisk ..... F04B 49/126 417/315
4,494,447 A * 1/1985 Sisk ..... F04B 49/126 417/315
4,573,880 A * 3/1986 Hirano ..... F04B 39/121 181/403
4,850,313 A * 7/1989 Gibbons ..... F02B 75/222 123/193.6
4,873,951 A * 10/1989 Garthwaite ..... F02B 75/007 123/196 W
4,988,269 A 1/1991 Blass
5,152,677 A * 10/1992 Bauer ..... F04B 39/06 417/366
5,203,228 A * 4/1993 Miyawaki ..... F16C 9/04 123/197.4
5,326,231 A * 7/1994 Pandeya ..... F01B 1/08 29/888.02
5,328,338 A * 7/1994 Hirano ..... F04B 39/102 137/527
5,733,108 A 3/1998 Rifle
5,762,479 A 6/1998 Baars et al.
5,846,059 A * 12/1998 Mizuno ..... F04B 27/0428 417/273
5,881,631 A * 3/1999 Ryu ..... F16J 1/16 92/187
5,950,579 A * 9/1999 Ott ..... F02B 61/02 123/197.3
5,957,667 A * 9/1999 Epp ..... F04B 37/18 417/271
6,190,137 B1 * 2/2001 Robbins ..... F04B 39/0094 417/221
6,409,481 B1 * 6/2002 Brabek ..... F04B 35/04 417/312
6,641,374 B2 11/2003 Kim
6,684,755 B2 * 2/2004 Boyd ..... F04B 39/0094 29/888.02
6,692,239 B2 * 2/2004 Nishikawa ..... F04B 25/00 417/312
6,832,900 B2 * 12/2004 Leu ..... F04B 27/005 417/415
7,210,912 B2 * 5/2007 Tomell ..... F04B 39/0055 181/403
7,396,219 B2 * 7/2008 Berwanger ..... F04B 39/023 181/403
7,422,423 B2 * 9/2008 Kawabata ..... F04B 39/0005 417/410.1
8,113,797 B2 * 2/2012 Valbjoern ..... F04B 35/04 310/215
8,435,013 B2 * 5/2013 Kondou ..... B01D 53/047 417/269
8,800,306 B2 8/2014 Schoenoff et al.
9,097,249 B2 * 8/2015 Petersen ..... F04B 1/0413
2004/0026201 A1 2/2004 Imasaka et al.
2004/0156731 A1 8/2004 Bond et al.
2004/0191094 A1 * 9/2004 Kojima ..... F04B 35/04 417/415
2005/0069431 A1 * 3/2005 Leu ..... F04B 27/005 417/415
2005/0106037 A1 5/2005 Kim et al.
2007/0098580 A1 * 5/2007 Petersen ..... F04B 1/0413 417/491
2009/0174741 A1 7/2009 Nagata et al.
2010/0034676 A1 2/2010 Kang et al.
2012/0023973 A1 * 2/2012 Mayorca ..... F04B 39/121 62/77

FOREIGN PATENT DOCUMENTS

CN 1769674 A 5/2006
NO 2007135152 A1 11/2007

* cited by examiner

METHOD AND EQUIPMENT FOR IMPROVING THE EFFICIENCY OF COMPRESSORS AND REFRIGERATORS

CROSS-REFERENCE TO RELATED APPLICATIONS

This application is a continuation-in-part of U.S. application Ser. No. 13/143,869 filed on Sep. 28, 2011, which is the U.S. national phase of PCT Appln. No. PCT/BR2010/000008 filed Jan. 8, 2010 which claims priority to Brazilian application PI 0903956-2 filed Jan. 9, 2009, the disclosures of which are incorporated in their entirety by reference herein.

TECHNICAL FIELD

The embodiments described herein relate to an apparatus and method for converting rotational motion into linear motion and evacuating non-compressible gases of a compressor.

BACKGROUND

A general hermetic compressor includes a motor portion and compressor portion sealed in a hermetic container. A compressor may be classified as reciprocating, rotary, or any other type where a refrigerant is compressed. In general, a hermetic compressor has a crank shaft coupled to a rotor of the motor part that transfers power to reciprocating pistons. The reciprocating pistons compress the compressible gas within a cylinder. Reciprocating pistons may be arranged in offset horizontal planes that cause unwanted forces on the crankpin and crankshaft. In order to compensate for the unwanted forces, larger crankshaft bearings may be required.

A lower part of the hermetic container may be filled with oil or a condensed fluid. An oil path is formed in an axial direction of the crank shaft, and an oil feeder is installed at a lower end of the oil path so as to be immersed in oil. As the crank shaft rotates, oil is pumped along the oil path to be fed, supplying the required components with lubrication. The hermetic container may be filled at the factory to properly seal the container. A factory fill may require additional transportation and installation costs.

SUMMARY

A hermetic compressor may include a hermetic shell having a shell and a base which collectively define an enclosed cavity. The hermetic shell may define a discharge port and a suction port. The hermitic compressor may include an electric motor having a stator disposed within the enclosed cavity on the base. The motor may have a rotary output. The compressor may be made of a cast-iron block and include a head assembly. The cast-iron block and head assembly may define a crankshaft axis. The cast-iron block may include a pair of directly opposed cylinders oriented perpendicular to the crankshaft axis, each having an inlet and an outlet port.

The compressor may include a crankshaft having an input shaft rotatably supported on the cast-iron block along the crankshaft axis and connected to the electric motor rotary output, and an eccentric crankpin orbitally rotating about the axis as the crankshaft is rotated. A pair of opposed pistons may lie on the common plane. Each piston may be pivotably connected to one of the connecting rod piston ends to drive the pistons in an oscillatory manner within the cylinders as the crankshaft rotates. The piston and cylinder pairs may cause fluid to be pumped from the inlet port to the outlet port as the piston oscillates varying the volume of the enclosed space bound by the piston and the cylinder pairs.

A pair of connecting rods may have a crankshaft end with a bearing opening surrounding the eccentric crankpin, a spaced apart piston end and a rod portion there between. The connecting rods may generally lie in a common plane perpendicular to the input shaft axis with each of the first ends axially offset from one another in a dogleg manner lying on opposite side of the common plane to surround the crankpin.

The connecting rod assembly may include a friction reduction element disposed between the connecting rod crankshaft ends and a plurality of spring feet mounted on the hermetic shell base in spaced apart relation for supporting the compressor on a support surface.

A pipe may connect the outlet port of a first cylinder to the inlet port of the other second cylinder in a serial fashion with the first cylinder inlet port coupled to the hermetic shell and the second cylinder outlet port discharging to the discharge port exiting the hermetic shell. In at least one other embodiment, a pair of outlet pipes connect the pair of outlet ports to the discharge port exiting the hermetic shell.

DETAILED DESCRIPTION

Figure 1:
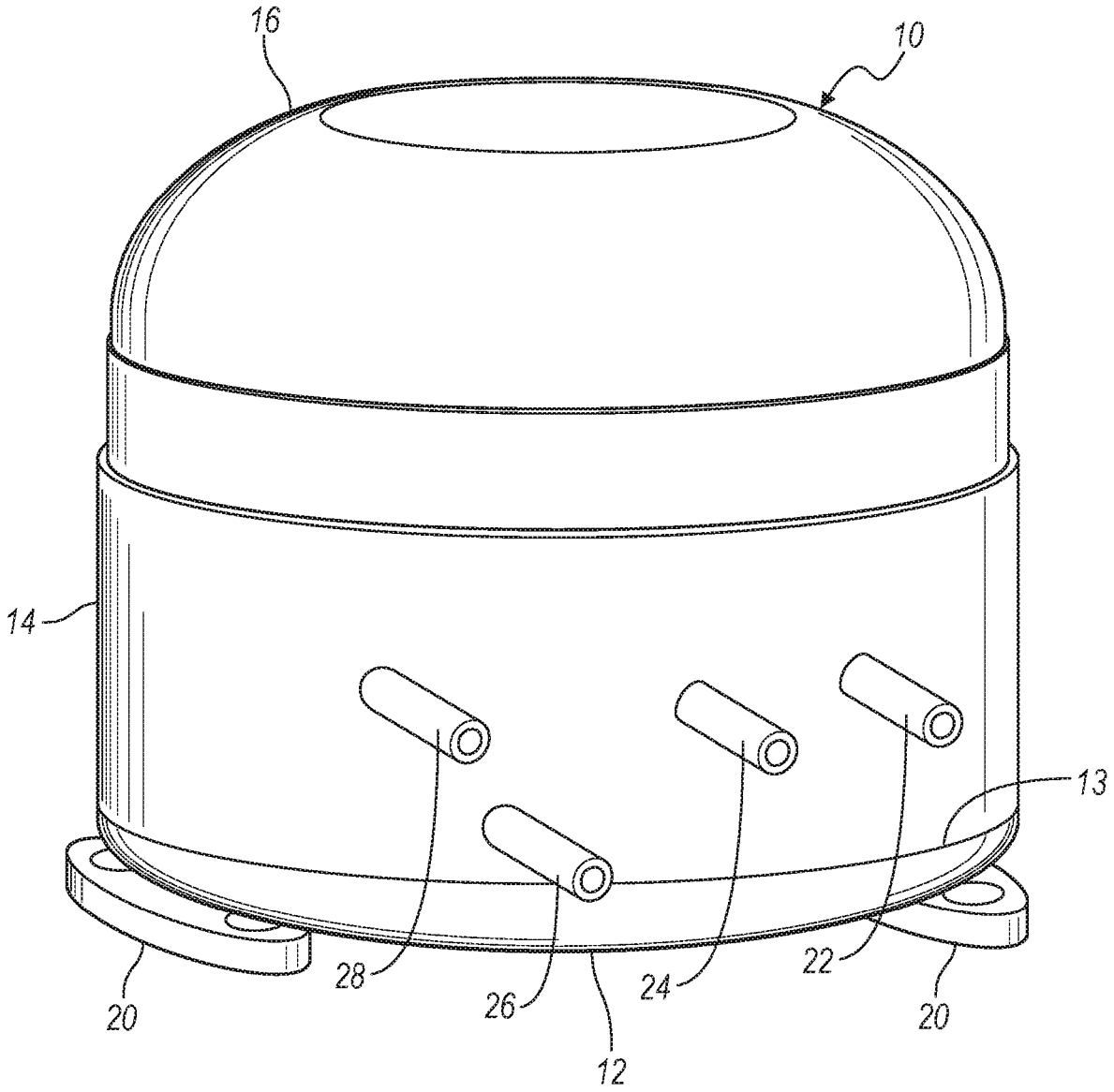
FIG. 1 is an isometric external view of the compressor used for refrigeration.

Referring to FIG. 1, a hermetically sealed compressor includes a hermetic shell 10 including a refill port 28, discharge port 24, suction port 22, and vent port 26. The hermetic shell 10 has a base 12, a body 14, and a top 16. The hermetic shell 10 contains an oil that fills the base 12 to a level near the seam 13 of the base 12 and body 14. The hermetic shell 10 has a vent port 26 disposed near the maximum level of the oil to release undesired, uncompressible accumulated gases.

The preferred embodiment improves on previous methods to evacuate trapped gases that are undesirable. Prior to the preferred embodiment, these trapped gases were evacuated at the site of manufacture by vacuum suction. The preferred embodiment includes a vent port 26 to release trapped air at the installation site. The vent port 26 is disposed above the seam 13 to prevent oil leakage during gas evacuation.

The vent port 26 provides an effective way to remove trapped gases that are undesirable at the installation site. The method for removing undesirable gases primarily uses the vent port 26 and the refill port 28. Initially, the vent port 26 is closed. Trapped moisture is then removed from the system by drawing a vacuum on the refill port 28. The hermetic shell 10 is then pressurized using the refill port 28 and refrigerant or inert gas. The internal pressure of the hermetic shell may be raised to any level sufficient to promote the release of undesirable gases. Typically, the hermetic shell 10 pressure is raised more than one quarter of the normal working pressure, but less than the full normal working pressure of the compressor.

The heavier air is then allowed to settle to the bottom of the hermetic shell, but above the level of the resting oil, which is generally located at the seam 13. The opening of the vent port 26 then releases undesirable gases from the hermetic shell, which leaves only oil and refrigerant gas retained in the shell.

An important requirement prior to the use of the hermetic compressor system is to ensure the proper amount of refrigerant is present in the system prior to use. Verification of adequate refrigerant may be performed numerous ways, but the following are example methods used to verify adequate refrigerant in the system.

The preferred method to ensure the compressor is adequately filled with refrigerant is to measure the weight and volume of the amount of air removed from the system through the vent port 26. This method is well known to those skilled in the art. The installer would then add refrigerant as necessary.

The second method to ensure the proper amount of refrigerant is to measure the internal pressure of the hermetic shell 10 and adjust the amount of refrigerant as necessary. This method is well known to those skilled in the art. The new process for high-efficiency cooling, described as putting gas in the sealed refrigeration systems free from any contamination, caters to all types of gas (e.g. R134 or R600).

Figure 2:
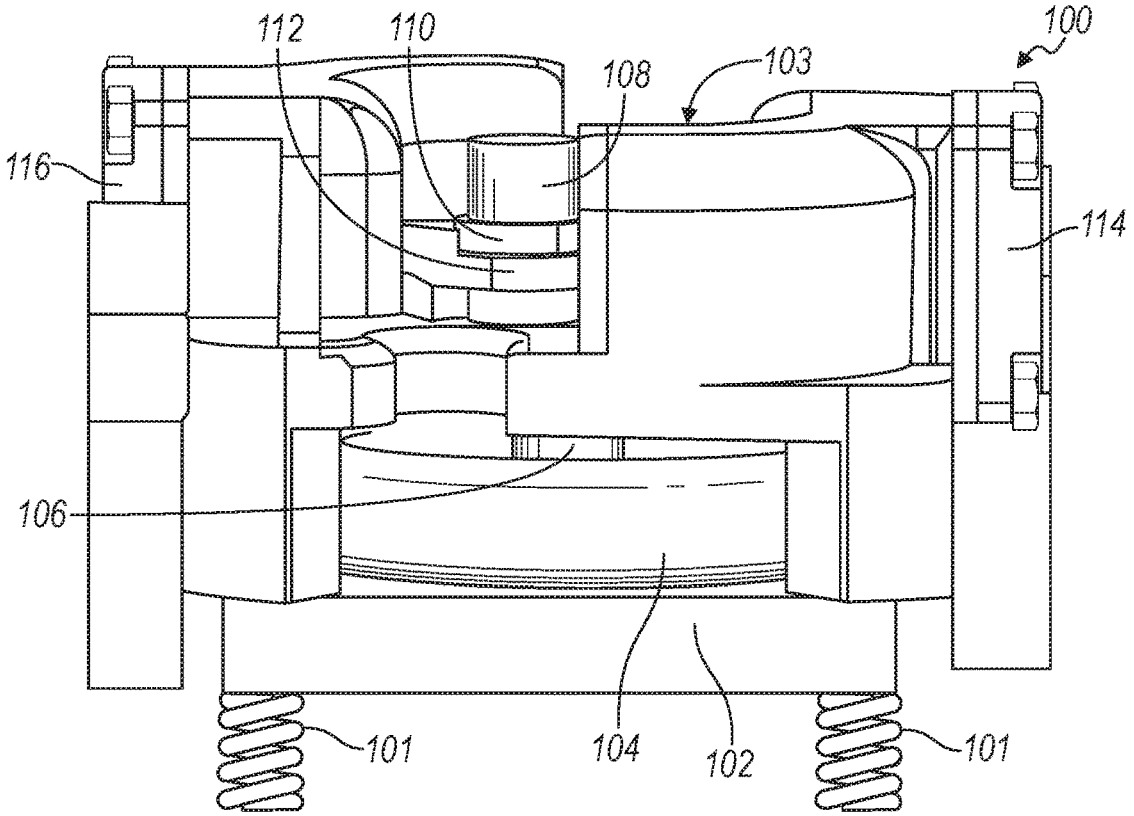
FIG. 2 is a sectional view of a dual cylinder hermetic refrigerant compressor without the hermetic compressor.
Figure 3:
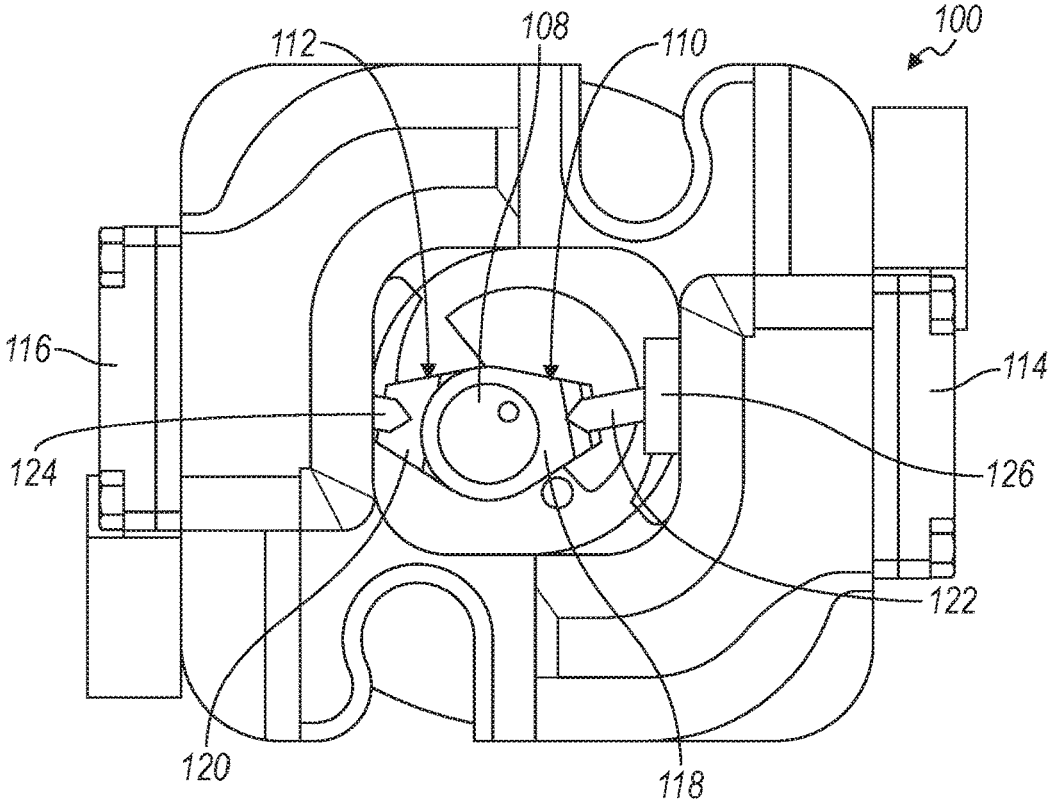
FIG. 3 is a top view of the compressor having a crankshaft and eccentric crankpin.

Now referring to FIGS. 2 and 3, the motor-compressor 100 has a cast-iron block 103 mounted within the hermetic shell. The motor-compressor 100 has a motor having a stator 102 and end windings 104. The motor-compressor 100 may be mounted on spring feet 101 to lift the stator 102 of the motor from the base 12 of the hermetic shell 10. The motor-compressor 100 may have a stator 102 including end turns or end windings 104 to generate a magnetic field, which generate torque on a rotor (not shown). The rotor may be attached to the crankshaft 106. The crankshaft may be attached to a crankpin 108. The crankshaft 106 and crankpin 108 may be a unitary piece. The crankshaft 106 may extend concentrically from the center axis of the stator 102 and motor-compressor 100. The crankshaft 106 has an eccentric crankpin 108 that orbits about the crankshaft 106. L-shaped connecting rods 110, 112 are disposed on the eccentric crankpin 108. The L-shaped connecting rods 110, 112 have a dogleg profile. The motor-compressor has a set of compression chamber heads 114, 116. Each of connecting rods 110, 112 include a bearing at the crankpin end or crankpin end portion 118, 120 to provide free rotation about the crankpin 108. Each of the connecting rods 110, 112 include a detachable piston end or piston end portion 122, 124 that connects to respective pistons 126, 128 (piston 128 not shown).

Figure 4:
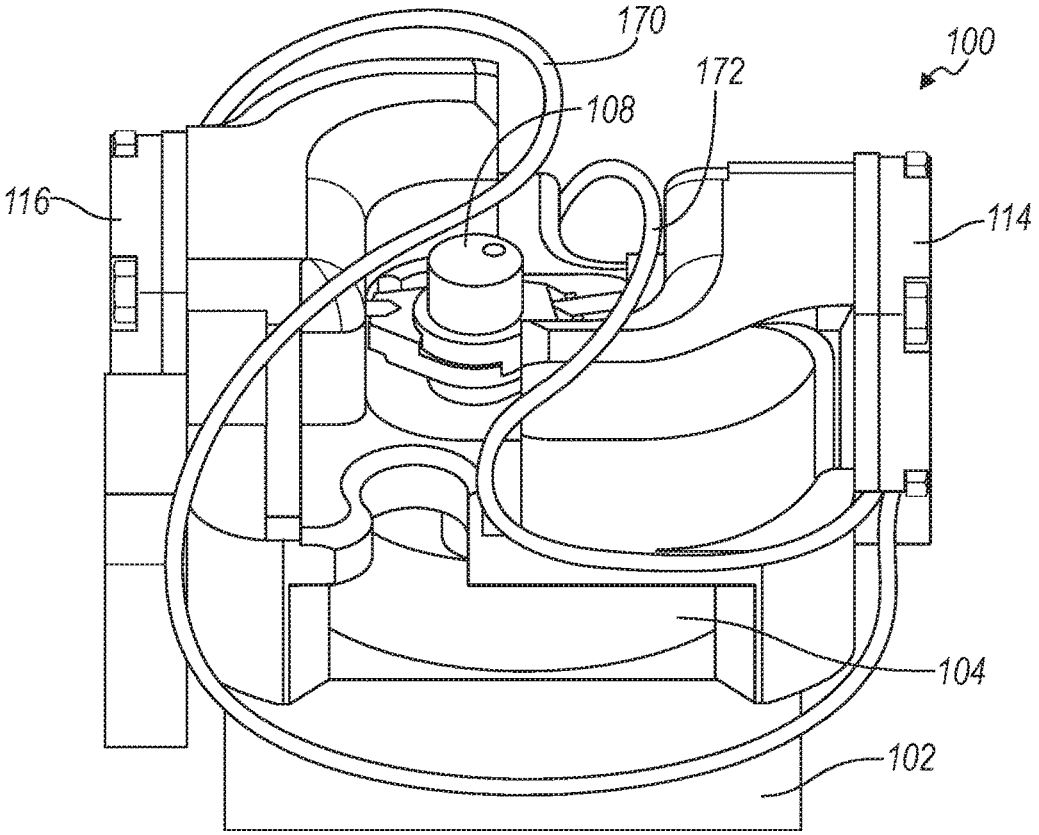
FIG. 4 is an isometric view of the compressor having serial discharge.
Figure 5:
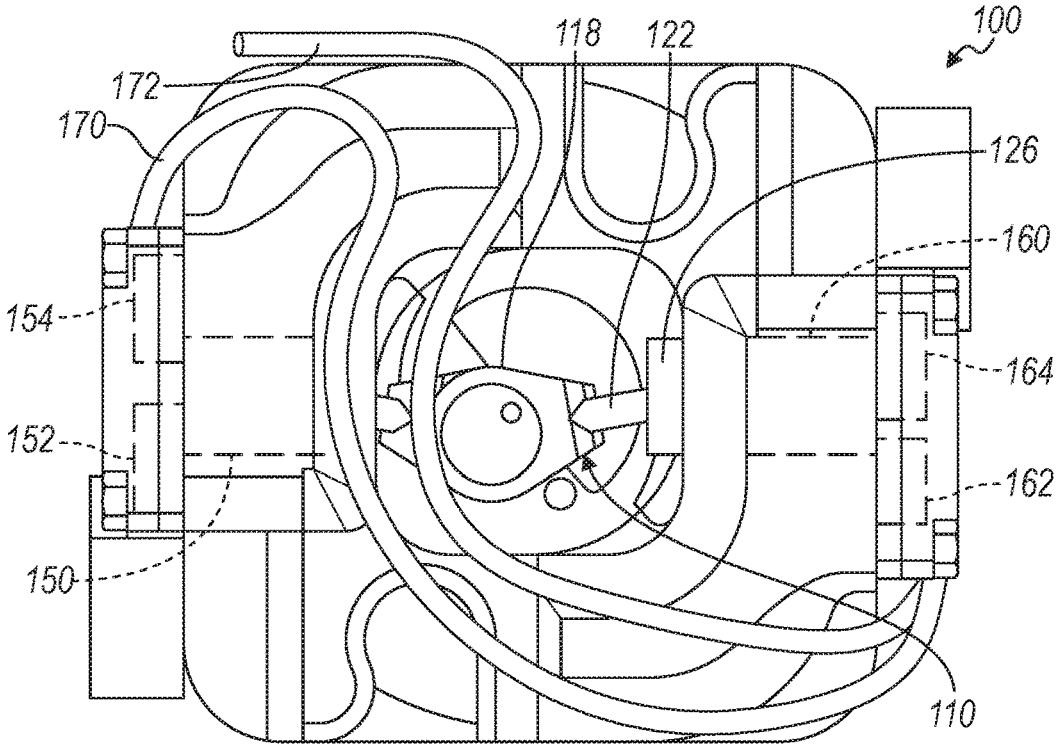
FIG. 5 is a top view of the compressor having serial discharge.

Now referring to FIGS. 4 and 5, an exemplary embodiment of serial discharge is shown. The first cylinder 150 has a first inlet port 152 that receives suction from the volume inside the hermetic shell or the suction port 22. The first cylinder 150 has a first outlet port 154 that is routed via piping 170 to the second inlet port 162 of the second cylinder 160. The second outlet port 164 of the second cylinder 160 is routed near the chamber head 116 and is further routed via piping 172 to the compressor discharge port 24 as shown in FIG. 1. This provides increased compression and reduced volume of the refrigerant gas.

Figure 6:
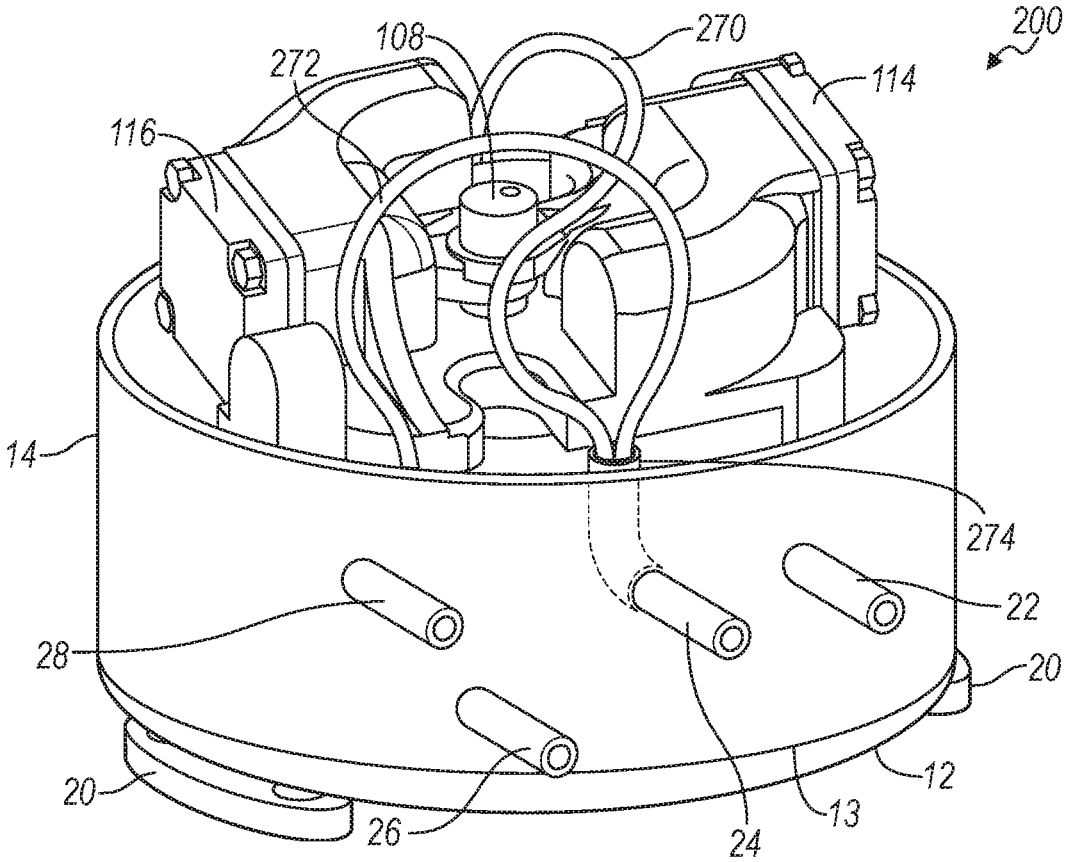
FIG. 6 is a view of the compressor having parallel discharge.

Now referring to FIG. 6, in at least one other embodiment a parallel discharge configuration 200 is shown. A pair of outlet pipes 270, 272 connect the pair of outlet ports (as shown in FIG. 5) of the cylinders to the discharge port exiting the hermetic shell. The first and second cylinders have respective outlet pipes 270, 272. The discharges are fed to a common manifold 274, which leads to the discharge port 24. The compressor has similar features to the series configuration of FIGS. 4 and 5. As shown, the compressor has an suction port 22, vent port 26, and refill port 28. The hermetic shell has a base 12, seam 13, and body 14. Each compression chamber head 114, 116 contains a cylinder (not shown). The compressor has an eccentric crankpin 108 that is free-standing on one end.

Figure 7:
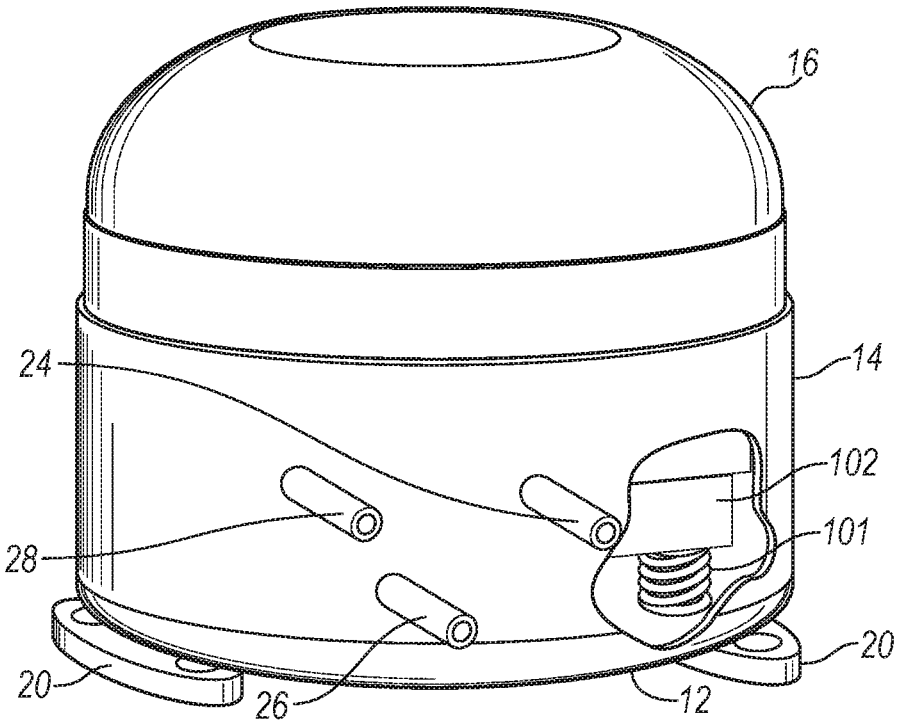
FIG. 7 is a view of the compressor having spring feet.

Now referring to FIG. 7, the compressor is shown being situated on spring feet 101, which are attached and support the stator 102. The spring feet 101 separate the base 12 and the stator 102. The spring feet 101 are fitted onto brackets welded to the inner wall of the airtight body. The compressor may include four spring feet 101 that are mounted to form a rectangle. The compressor has separate mounting feet 20 for mounting and stabilization.

Figure 8:
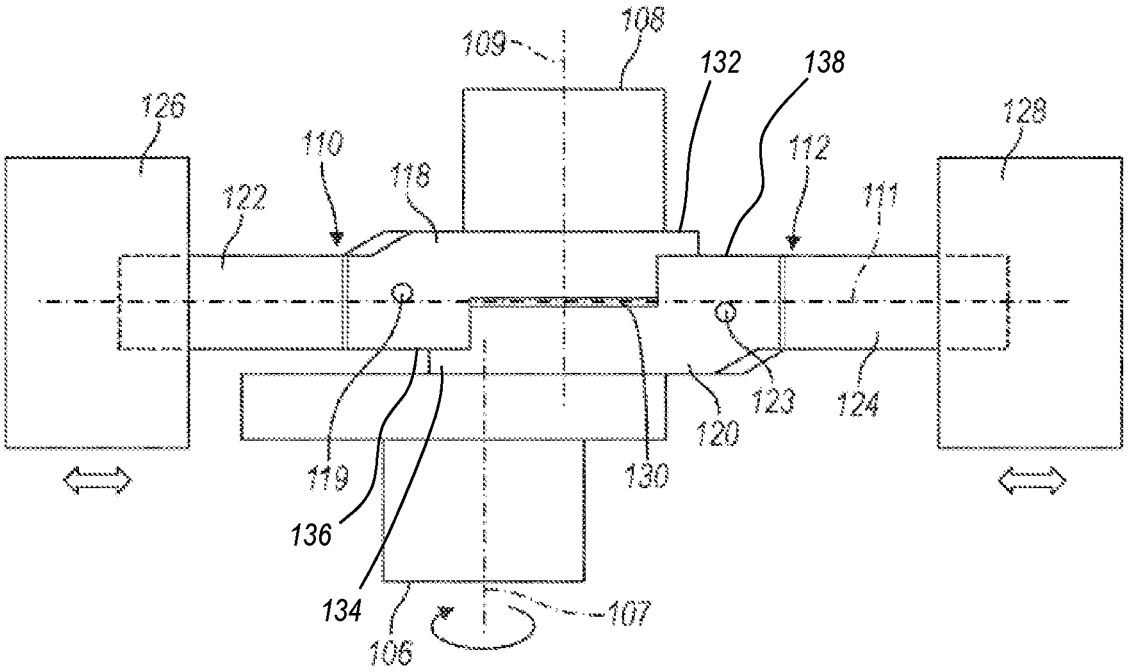
FIG. 8 is a side vertical view of the eccentric and the two bearings.
Figure 9:
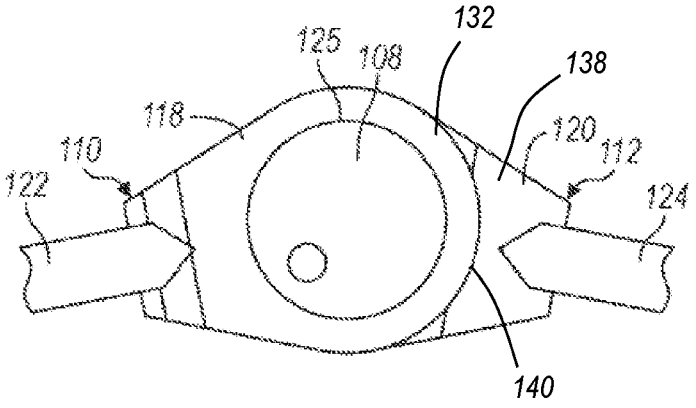
FIG. 9 is a top sectional view of the eccentric and the two bearings.

Now referring to FIGS. 8 and 9, the L-shaped connecting rod 110 defines a hole 119 on the crankpin end 118 of the connecting rod 110. The hole 119 may be used to connect the crankpin end 118 and piston end 122. The crankpin end 118 of the connecting rod 110 is rotationally attached to the crankpin 108 with a bearing sized to receive the crankpin 108. The crankpin end 118 can then orbit about the crankshaft 106, which has a crankshaft axis 107, along with the crankpin 108. The orbiting motion of the crankpin end 118 causes the attached piston end 122 to reciprocate. The reciprocating motion of the piston end 122 causes the piston 126 to similarly reciprocate. The reciprocating motion of the piston 126 compresses the compressible gas of the cylinder.

The L-shaped connecting rod 110 as described above has a symmetric companion L-shaped connecting rod 112. The companion L-shaped connecting rod 112 defines a hole 123 on crankpin end 120 of the connecting rod 112. The hole 123 may be used for a pin to connect the crankpin end 120 and piston end 124. The crankpin end 120 of the connecting rod 112 is rotationally attached to the crankpin 108 with a bearing sized to receive the crankpin 108. The crankpin end 120 can then orbit about the crankshaft 106 along with the crankpin 108. The orbiting motion of the crankpin end 120 causes the attached piston end 124 to reciprocate. The reciprocating motion of the piston end 124 causes the piston 128 to similarly reciprocate. The reciprocating motion of the piston 126 compresses the compressible gas of the cylinder.

The companion L-shaped connecting rod 112 is flipped about a horizontal plane 111, which is perpendicular to the eccentric axis or crankpin axis 109, such that the piston ends 122, 124 of both connecting rods 110, 112 are aligned along a common horizontal plane 111. The piston end 124 of the companion L-shaped connecting rod 112 is oriented in the opposite direction of the piston end 122 of the L-shaped connecting rod 110. Further, the connecting rods 110, 112 interleave with each other. Specifically, crankpin end 118 of connecting rod 110 has a semicircular portion 132 opposite the crankpin 108 from the side of crankpin end 118 that joins to the piston end 122. Similarly, crankpin end 120 of connecting rod 112 has a semicircular portion 134 opposite the crankpin 108 from the side of crankpin end 120 that joins to piston end 124. Semicircular portion 132 of crankpin end 118 lies entirely on one side of the horizontal plane 111, and semicircular portion 134 of crankpin end 120 lies entirely on the opposite side of horizontal plane 111 from semicircular portion 132. The side of crankpin end 120 that connects to piston end 124 has a portion 138 that extends across the horizontal plane 111, and has an arcuate recess 140 in which semicircular portion 132 of crankpin end 118 partially sits. Likewise, crankpin end 118, at the end of crankpin end 118 that connects to piston end 122, has a portion 136 that extends across the horizontal plane 111, in which semicircular portion 134 of crankpin end 120 partially sits in a similar arcuate recess. Further, both piston end 122 of connecting rod 110 and piston end 124 of connecting rod 112 each have a longitudinal axis, from their respective crankpin end 118, 120 to their respective pistons 126, 128 that is entirely on the horizontal plane 111.

The orientation of the companion L-shaped connecting rod 112 to the L-shaped connecting rod 110 is one of the novel aspects of the embodiment because the piston ends 122, 124 of the connecting rods 110, 112 operate on the same horizontal plane 111. This provides enhanced symmetry for the compressor because each of the pistons 126, 128 are disposed on the same plane and create opposing forces. This configuration allows reciprocating movement of the pistons 126, 128 in the same plane without undesirable stresses.

Conflicting rotation of the connecting rods 110, 112 may cause unwanted friction and restricted movement. A thin washer 130 may be disposed between the L-shaped connecting rods 110, 112 may have a thickness between 0.1 mm and 0.3 mm. The washer may relieve mechanical friction, which tends to create counter force to the rotation of the bearing with respect to each other.

The connecting rods 110, 112 form a tear shape truncated toward the piston ends 122, 124. Each of the connecting rods 110, 112 define a bearing opening 125, 127 on respective connecting rod crankpin ends 118, 120. The connecting rod crankpin ends 118, 120 also define a cleft for receiving the piston ends 122, 124 of the connecting rods 110, 112. The pistons 126, 128 are connected on the distal end of the connecting rod piston ends 122, 124. The compressor pistons 126, 128 reciprocate within the cylinders (not shown).

What is claimed is:

1. A hermetic compressor comprising:

a hermetic shell having a she and a base which collectively define an enclosed cavity, with a discharge port, and suction port defined in the hermetic shell;

an electric motor having a stator and disposed within the enclosed cavity, on the base, the motor having a rotary output;

a compressor having:

a single cast-iron block and head assembly having a crankshaft with a crankshaft axis, and a pair of axially aligned directly opposed cylinders oriented perpendicular to the crankshaft axis, each having an inlet and an outlet port, and a single, non-split bushing in an opening through a base of the single cast-iron block along the crankshaft axis;

the crankshaft having an input shaft portion rotatably supported by and passing through the single, non-split bushing on the single cast-iron block along the crankshaft axis, and connected to a rotary output of the electric motor at a first end of the crankshaft, and having, at a second end of the crankshaft opposite the first end of the crankshaft and the base of the single cast-iron block, an eccentric crankpin that is free standing at an end of the crankshaft and orbitally rotating about the crankshaft axis between the opposed cylinders as the crankshaft is rotated;

a pair of connecting rods each having a crankpin end with a bearing opening surrounding the eccentric crankpin, the crankpin end of each connecting rod connected to a piston end of the connecting rod that is a rod portion, wherein the piston ends of the connecting rods each have a longitudinal axis that lie in a common horizontal plane perpendicular to the crankshaft axis, with each of the crankpin ends axially offset from one another in a dogleg manner lying on opposite sides of the common plane to surround the eccentric crankpin, and wherein the connecting rods are positioned in an opposing configuration about the eccentric crankpin such that the longitudinal axis of each of the piston ends remain in the common plane as the crankshaft rotates, and wherein the crankpin ends each having a hole through which the eccentric crankpin passes;

a friction reduction washer disposed on the eccentric crankpin between the crankpin ends of the pair of connecting rods;

a pair of opposed pistons lying on the common plane, each piston pivotably connected to one of the connecting rod piston ends to drive the pistons in an oscillatory manner within the cylinders as the crankshaft rotates, wherein piston and cylinder pairs cause fluid to be pumped from their respective inlet ports to the respective outlet ports as the piston oscillates, varying a volume of an enclosed space bound by the piston and the cylinder pairs, wherein the pistons reciprocate 180 degrees out of phase with respect to each other; and a plurality of spring feet mounted on the hermetic she base in spaced apart relation supporting the electric motor.

2. The compressor of claim 1, wherein a pipe connects the outlet port of a first cylinder of the pair of cylinders to the inlet port of the other of the pair of cylinders in a serial fashion with the first cylinder inlet port coupled to the hermetic shell and the other cylinders outlet port discharging to the discharge port exiting the hermetic shell.

3. The compressor of claim 1, wherein a pair of outlet pipes connect the respective outlet ports of the pair of cylinders to the discharge port exiting the hermetic shell.

4. The compressor of claim 1, wherein, in each of the pair of connecting rods, the crankpin end and the piston end are joined with a pin, and wherein the piston end couples to the crankpin end at a "V" shaped cleft formed in the crankpin end.

5. The compressor of claim 1, further comprising a suction port coupled with the shell, the suction port providing a suction opening through the shell through which a compressed refrigerant can pass.

6. The compressor of claim 1, wherein the pair of connecting rods comprises a first connecting rod and a second connecting rod, and wherein the second connecting rod is symmetric to the first connecting rod but, in an assembled position within the single cast iron block, is flipped about the common horizontal plane relative to the first connecting rod and wherein a semicircular portion of the crankpin end of the first connecting rod lies entirely on one side of the common horizontal plane and partially sits in an arcuate recess in a portion of the crankpin end of the second connecting rod that extends across the common horizontal plane, and a semicircular portion of the crankpin end of the second connecting rod lies entirely on the opposite side of the common horizontal plane from the semicircular portion of the crankpin end of the first connecting rod and partially sits in an arcuate recess in a portion of the crankpin end of the first connecting rod that extends across the common horizontal plane.

7. The compressor of claim 1, wherein:

the pair of connecting rods comprises a first and a second connecting rod;

the crankpin end of the first connecting rod has a recess;

the crankpin end of the second connecting rod has a recess; and in an assembled state within the single cast iron block, an end portion of the piston end of the first connecting rod is positioned in the recess of the crankpin end of the first connecting rod and an end portion of the piston end of the second connecting rod is positioned in the recess of the crankpin end of the second connecting rod such that a centerline, of the piston end of the first connecting rod is positioned on the horizontal plane within the single cast iron block and a centerline of the piston end of the second connecting rod is positioned on the horizontal plane to enable the first and second pistons to move along an axis in the horizontal plane within the single cast iron block.

8. The compressor of claim 6, wherein the crankpin ends of the first and second connecting rods each have an L shaped profile.

9. The compressor of claim 1, wherein the friction reduction washer comprises a flat washer having a thickness between 0.0039 inch to 0.0118 inch.

10. A compressor comprising:

a housing having an enclosed cavity therein, the housing having oil disposed in a lower portion of the housing, the housing having a refill port, a discharge port, a suction port, and a vent port, wherein the vent port is positioned above and adjacent a maximum level of the oil and the refill port, discharge port, and suction port are located higher on the housing than the vent port;

an electric motor supported within the enclosed cavity, the electric motor having a stator and a rotor to provide a rotary output;

a compressor supported within the enclosed cavity, the compressor comprising:

a single piece cast-iron block comprising:

a base portion comprising a first surface, a second surface, a first portion, and a second portion;

a first opening that extends through the base portion through the first surface and the second surface, the first opening defining a first axial centerline that is normal to at least the first surface;

a first head portion that extends away from the second surface of the base portion in a direction that is parallel to the first axial centerline, the first head portion being positioned on the first portion of the base portion;

a first cylinder that extends into the first head portion along a second axial centerline, wherein:

the second axial centerline is perpendicular to the first axial centerline; and the first cylinder has an inlet port and an outlet port;

a second head portion that extends away from the second surface of the base portion in a direction that is parallel to the first axial centerline, the second head portion being positioned on the second portion of the base portion; and a second cylinder that extends into the second head portion along the second axial centerline such that the first and second cylinders are coaxial and opposing about the first axial centerline, wherein the second axial centerline extends through the center of the first and second cylinders;

a crankshaft extending through the first opening of the base portion and being configured to rotate relative to the block, the crankshaft being coupled with the electric motor on a first side of the base portion;

a crankpin that is free standing at an end of the crankshaft and configured to rotate about the first axial centerline, as the crankshaft is rotated, between the first and second cylinders on a second side of the base;

a first piston configured to translate along the second axial centerline within the first cylinder, and a first connecting rod having a piston end coupled with the first piston and a crankpin end coupled the crankpin;

a second piston configured to translate along the second axial centerline within the second cylinder 180 degrees out of phase with respect to the first piston, and a second connecting rod having a piston end coupled with the second piston and having a crankpin end coupled the crankpin, wherein:

the second connecting rod is symmetric to the first connecting rod but, in an assembled position, is flipped about a horizontal plane that is perpendicular to the first axial centerline relative to the first connecting rod so that a longitudinal axis of the piston end of the first connecting rod lies in the horizontal plane and a longitudinal axis of the piston end of the second connecting rod lies in the horizontal plane; and a friction reduction washer disposed around the eccentric crankpin between the crankpin end of the first connecting rod and the crankpin end of the second connecting rod.

11. The compressor of claim 10, wherein the friction reduction washer comprises a flat washer having a thickness between 0.0039 inch to 0.0118 inch.

12. The compressor of claim 10, further comprising a suction port coupled with the housing, the suction port providing a suction opening through the housing through which a compressed refrigerant can pass.

13. The compressor of claim 10, wherein each of the first and second of connecting rods is comprised of crankshaft end portion and piston end portion, wherein the piston end portion of the first connecting rod is joined to the first piston with a pin, and the piston end portion of the second connecting rod is joined to the second piston with a pin.

14. The compressor of claim 10, wherein a semicircular portion of the crankpin end of the first connecting rod lies entirely on one side of the horizontal plane and partially sits in an arcuate recess in a portion of the crankpin end of the second connecting rod that extends across the horizontal plane, and a semicircular portion of the crankpin end of the second connecting rod lies entirely on the opposite side of the horizontal plane from the semicircular portion of the crankpin end of the first connecting rod and partially sits in an arcuate recess in a portion of the crankpin end of the first connecting rod that extends across the horizontal plane.

15. The compressor of claim 10, wherein:

the pair of connecting rods comprises a first and a second connecting rod;

the crankpin end of the first connecting rod has a recess;

the crankpin end of the second connecting rod has a recess; and in an assembled state within the single cast iron block, an end portion of the piston end of the first connecting rod is positioned in the recess of the crankpin end of the first connecting rod and an end portion of the piston end of the second connecting rod is positioned in the recess of the crankpin end of the second connecting rod such that a centerline of the piston end of the first connecting rod is positioned on the horizontal plane within the single cast iron block and a centerline of the piston end of the second connecting rod is positioned on the horizontal plane to enable the first and second pistons to move along an axis in the horizontal plane within the single cast iron block.

16. The compressor of claim 10, wherein the first and second connecting rods each have an L shaped profile.

17. A hermetic compressor, comprising:

a hermetic shell having a shell and a base which collectively define an enclosed cavity, with a discharge port, refill port, vent port, and suction port formed through the hermetic shell, wherein the vent port is lower on the hermetic shell than the discharge portion, suction port, and refill port;

an electric motor having a stator and disposed within the enclosed cavity on the base, the motor having a rotary output;

a single cast-iron block and head assembly disposed above the electric motor and having a block base, the block base having a crankshaft with a crankshaft axis through a central crankshaft opening in the block base to the electric motor below the single cast-iron block, the single cast-iron block further having a pair of directly opposed cylinders oriented perpendicular to, and about the crankshaft axis on a top side of the block base, each of the of the directly opposed cylinders having an inlet and an outlet port;

the crankshaft having an input shaft rotatably supported by, and passing through the central crankshaft opening and connected to the electric motor at a first end of the crankshaft, the crankshaft further having, at a second end of the crankshaft opposite the first end of the crankshaft, above the block base, an eccentric crankpin that is free standing at the second end of the crankshaft and which is configured to rotate orbitally about the crankshaft axis between the opposed cylinders;

a first connecting rod connected to a first piston in a first one of the opposing cylinders, and a second connecting rod connected to a second piston in a second one of the opposing cylinders each of the first and second connecting rods having a crankpin end with a bearing opening surrounding the eccentric crankpin, the crankpin end of each connecting rod connected to a piston end of the connecting rod that is a rod portion, wherein the piston ends of the connecting rods each have a longitudinal axis that lie in a common horizontal plane perpendicular to crankshaft axis, wherein a semicircular portion of the crankpin end of the first connecting rod lies entirely on one side of the horizontal plane and partially sits in an arcuate recess in a portion of the crankpin end of the second connecting rod that extends across the horizontal plane, and a semicircular portion of the crankpin end of the second connecting rod lies entirely on the opposite side of the horizontal plane from the semicircular portion of the crankpin end of the first connecting rod and partially sits in an arcuate recess in a portion of the crankpin end of the first connecting rod that extends across the horizontal plane; and a friction reduction washer disposed on the eccentric crankpin between the-crankpin ends of the pair of connecting rods.

* * * * *